US007071467B2

(12) United States Patent
Bateman et al.

(10) Patent No.: US 7,071,467 B2
(45) Date of Patent: Jul. 4, 2006

(54) MASS SPECTROMETER

(75) Inventors: Robert Harold Bateman, Knutsford (GB); Kevin Giles, Altrincham (GB); John Brian Hoyes, Stockport (GB); Steve Pringle, Hoddlesden (GB); Jeff Brown, Mottram-in-Longdendale (GB)

(73) Assignee: Micromass UK Limited, Manchester (GB)

( * ) Notice: Subject to any disclaimer, the term of this patent is extended or adjusted under 35 U.S.C. 154(b) by 137 days.

(21) Appl. No.: 10/633,702

(22) Filed: Aug. 5, 2003

(65) Prior Publication Data

US 2005/0023453 A1 Feb. 3, 2005

Related U.S. Application Data

(60) Provisional application No. 60/427,559, filed on Nov. 20, 2002.

(30) Foreign Application Priority Data

Aug. 5, 2002 (GB) ..... 0218139.4
Apr. 11, 2003 (GB) ..... 0308418.3

(51) Int. Cl.
*H01J 49/40* (2006.01)

(52) U.S. Cl. ..... 250/292

(58) Field of Classification Search ..... 250/281, 250/282, 292
See application file for complete search history.

(56) References Cited

U.S. PATENT DOCUMENTS 3,778,678 A 12/1973 Masuda
3,806,763 A 4/1974 Masuda
3,872,361 A 3/1975 Masuda
5,140,158 A 8/1992 Post
5,206,506 A 4/1993 Kirchner
5,569,917 A * 10/1996 Buttrill et al. ..... 250/292
5,572,035 A 11/1996 Franzen
5,811,800 A 9/1998 Franzen et al.
5,818,055 A 10/1998 Franzen
5,847,386 A 12/1998 Thomson et al.
5,905,258 A 5/1999 Clemmer et al.
6,107,628 A 8/2000 Smith et al.
6,323,482 B1 11/2001 Clemmer et al.
6,403,953 B1 6/2002 Whitehouse et al.

(Continued)

FOREIGN PATENT DOCUMENTS

CA 2281405 3/2000

(Continued)

OTHER PUBLICATIONS

Hu et al., "Design of Traveling-Wave Field Panel for Pharmaceutical Powders Based on Computer Simulation of Particle Trajectories", IEEE Transactions on Industry Applications, vol. 33, No. 3, pp. 641-650, 1997.

(Continued)

*Primary Examiner*—Kiet T. Nguyen
(74) *Attorney, Agent, or Firm*—Diederiks & Whitelaw PLC

(57) ABSTRACT

A mass spectrometer is disclosed comprising an ion trap wherein ions which have been temporally separated according to their mass to charge ratio or ion mobility enter the ion trap. Once at least some of the ions have entered the ion trap, a plurality of ion trapping regions are created along the length of the ion trap in order to fractionate the ions. Alternatively, the ions may be received within one or more axial trapping regions which are translated along the ion trap with a velocity which is progressively reduced to zero.

97 Claims, 4 Drawing Sheets

ELECTRICAL POTENTIAL PROFILE

U.S. PATENT DOCUMENTS

| | | | | |
|---|---|---|---|---|
| 6,417,511 | B1 | 7/2002 | Russ, IV et al. | |
| 6,489,610 | B1 | 12/2002 | Barofsky et al. | |
| 6,498,342 | B1 | 12/2002 | Clemmer | |
| 6,545,268 | B1 | 4/2003 | Verentchikov et al. | |
| 6,559,444 | B1 | 5/2003 | Franzen | |
| 6,670,606 | B1 | 12/2003 | Verentchikov et al. | |
| 6,693,276 | B1 | 2/2004 | Weiss et al. | |
| 6,744,042 | B1 * | 6/2004 | Zajfman et al. | 250/287 |
| 2001/0032929 | A1 | 10/2001 | Fuhrer et al. | |
| 2002/0063207 | A1 | 5/2002 | Bateman et al. | |
| 2002/0063209 | A1 | 5/2002 | Bateman et al. | |
| 2002/0063210 | A1 | 5/2002 | Bateman et al. | |
| 2002/0079443 | A1 | 6/2002 | Krutchinsky et al. | |
| 2002/0113207 | A1 | 8/2002 | Lee et al. | |
| 2002/0148959 | A1 | 10/2002 | Weiss et al. | |
| 2002/0190200 | A1 | 12/2002 | Zajfman et al. | |

FOREIGN PATENT DOCUMENTS

| | | | |
|---|---|---|---|
| EP | 1 378 930 | A2 | 5/2003 |
| EP | 1 367 633 | A3 | 12/2003 |
| GB | 2 315 364 | A | 1/1998 |
| GB | 2375653 | | 11/2002 |
| GB | 2 381 948 | A | 5/2003 |
| GB | 2 381 949 | A | 5/2003 |
| JP | 11-307040 | | 11/1999 |
| JP | 2000-113852 | | 4/2000 |
| JP | 2000-123780 | | 4/2000 |
| WO | WO 92/14259 | | 8/1992 |
| WO | WO 94/01883 | | 1/1994 |
| WO | WO 97/49111 | | 12/1997 |
| WO | WO 01/078106 | A3 | 10/2001 |
| WO | WO 02/43105 | | 5/2002 |
| WO | WO 02/103747 | A1 | 12/2002 |

OTHER PUBLICATIONS

Masuda et al., "Approximate Methods For Calculating a Non-Uniform Travelling Field", Journal of Electrostatics, vol. 1, pp. 351-370, 1975.

Masuda et al., "Characteristics of Standing-Wave, Ring-Type Electric Curtain. Experimental Study", Electrical Engineering in Japan, vol. 93, No. 1, pp. 78-83, 1973.

Masuda et al., "Separation of Small Particles Suspended in Liquid by Nonuniform Traveling Field", IEEE Transactions on Industry Applications, vol. 1A-23, No. 3, pp. 474-480, 1987.

Masuda et al., "Approximation for Calculating Nonuniform Traveling Fields", Electrical Engineering In Japan, vol. 96, No. 5, pp. 25-31, 1976.

Gerlich, "Inhomogeneous RF Fields: A Versatile Tool For the Study of Processes With Slow Ions", Adv. In Chem. Phys. Ser., vol. 82, Ch. 1, pp. 1-176, 1992.

Teloy et al., "Integral Cross Sections For Ion-Molecule Reactions. I. The Guided Beam Technique", Chemical Physics, vol. 4, pp. 417-427, 1974.

Dodonov et al., "A New Technique For Decomposition of Selected Ions in Molecule Ion Reactor Coupled With Ortho-Time-Of-Flight Mass Spectrometry", Rapid Communications in Mass Spectrometry, vol. 11, pp. 1649-1656, 1997.

Shaffer et al., "A Novel Ion Funnel for Ion Focusing at Elevated Pressures", ASMS Book of Abstracts, pp. 375, 1997.

Gerlich et al., "Ion Trap Studies of Association Processes in Collisions of $CH_3^+$ and $CD_3^+$ With n-$H_2$, p-$H_2$, $D_2$, and He at 80 K", Astrophysical Journal, vol. 347, pp. 849-854, 1989.

Shaffer et al., "An Ion Funnel Interface for Improved Ion Focusing and Sensitivity Using Electrospray Ionization Mass Spectrometry", Analytical Chemistry, vol. 70, pp. 4111-4119, 1998.

Shaffer et al., "Characterization of an Improved Electrodynamic Ion Funnel Interface for Electrospray Ionization Mass Spectrometry", Analytical Chemistry, vol. 71, pp. 2957-2964, 1999.

Kim et al., "Design and Implementation of a New Electrodynamic Ion Funnel", Analytical Chemistry, vol. 72, pp. 2247-2255, 2000.

Tolmachev et al., "Charge Capacity Limitations of Radio Frequency Ion Guides in Their Use for Improved Ion Accumulation and Trapping in Mass Spectrometry". Analytical Chemistry, vol. 72, pp. 970-978, 2000.

Giles et al., "Evaluation of a Stacked-Ring Radio Frequency Ion Transmission Device at Intermediate Pressures", ASMS Book of Abstract, pp. 1, 2001.

Gerlich, "Rf Ion Guides", Encyclopedia of Mass Spectrometry, vol. 5, Chemistry and Physics of Gas-Phase Ions, pp. 1-34, 2003.

Luca et al., "On the Combination of a Linear Field Free Trap With a Time-Of Flight Mass Spectrometer", Review of Scientific Instruments, vol. 72, No. 7, pp. 2900-2908, 2001.

Guan et al., "Stacked-Ring Electrostatic Ion Guide", J. Am. Soc. Mass Spec., vol. 7, pp. 101-106, 1996.

Franzen, "Electrical Ion Guides", ASMS Book of Abstracts. pp. 1170, 1996.

Shaffer et al., "A Novel Ion Funnel For Focusing Ions at Elevated Pressure Using Electrospray Ionization Mass Spectrometry", Rapid Communications in Mass Spectrometry, vol. 11, pp. 1813-1817, 1997.

* cited by examiner

MASS SPECTROMETER

CROSS-REFERENCE TO RELATED APPLICATIONS

This application claims the benefit of the filing of U.S. Provisional Patent Application Ser. No. 60/427,559 filed Nov. 20, 2002.

BACKGROUND OF THE INVENTION

1. Field of the Invention

The present invention relates to a mass spectrometer and a method of mass spectrometry.

2. Discussion of the Prior Art

A common form of tandem mass spectrometry (MS/MS) involves transmitting ions emitted from an ion source through a mass filter arranged upstream of a gas collision cell. The mass filter is set so that only ions having a specific mass to charge ratio are onwardly transmitted to the gas collision cell. Ions having other mass to charge ratios are attenuated by the mass filter. Ions transmitted by the mass filter then enter the gas collision cell and are induced to fragment. Fragment ions formed within the gas collision cell exit the gas collision cell and are then mass analysed by, for example, an orthogonal acceleration Time of Flight mass analyser arranged downstream of the gas collision cell. Analysis of the fragment ions provides an effective means of identifying the parent ion which fragmented to produce the fragment ions.

A problem with known tandem mass spectrometers is that the duty cycle can be relatively poor in applications where there is a need to identify or quantify many different components from a sample. The poor duty cycle is due to the fact that whilst parent ions having a desired mass to charge ratio are transmitted through the mass filter all other parent ions are effectively attenuated by the mass filter and are lost. The duty cycle and hence sensitivity further decreases as the number of components to be analysed increases.

SUMMARY OF THE INVENTION

According to an aspect of the present invention there is provided a mass spectrometer comprising:

an ion trap comprising a plurality of electrodes wherein at a first time $t_1$ ions enter the ion trap and wherein at a second later time $t_2$ a plurality of axial trapping regions are formed or created along at least a portion of the length of the ion trap.

The preferred embodiment relates to an ion trap which is capable of fractionating ions. Ions preferably enter the ion trap having been temporally or spatially separated according to a physico-chemical property such as, for example, mass to charge ratio or ion mobility in gas phase. According to other less preferred embodiments the ions may be separated according to another property such as, for example, elution time, hydrophobicity, hydrophilicity, migration time, chromatographic retention time, solubility, molecular volume or size, net charge, charge state, ionic charge, composite observed charge state, isoelectric point (pI), dissociation constant (pKa), antibody affinity, electrophoretic mobility, ionisation potential, dipole moment, hydrogen-bonding capability or hydrogen-bonding capacity.

Ions having been separated according to a physico-chemical property then become trapped and stored in a series of axial ion trapping potential wells or axial ion trapping regions along the length of the ion trap. The ions are preferably stored in the ion trap for subsequent analysis or experimentation. For example, the ions stored in one or more of the axial potential wells may be subsequently released for mass analysis, for fragmentation and subsequent mass analysis, or for mass selection, fragmentation and mass analysis.

The preferred ion trap when incorporated into a mass spectrometer enables a high duty cycle to be obtained for both MS and MS/MS modes of operation.

According to one embodiment at least 2, 3, 4, 5, 6, 7, 8, 9, 10, 11, 12, 13, 14, 15, 16, 17, 18, 19, 20, 21, 22, 23, 24, 25, 26, 27, 28, 29, 30 or more than 30 axial trapping regions are created or formed at time $t_2$. According to the preferred embodiment the plurality of axial trapping regions are preferably created at substantially the same time $t_2$. However, according to less preferred embodiments the axial trapping regions may be created in stages i.e. some axial trapping regions may be created at time $t_2$ and then further axial trapping regions may be created or formed after a slight delay.

At the first time $t_1$ in the region intermediate the entrance and exit of the ion trap no axial trapping regions are preferably provided along at least the intermediate portion of the ion trap. The entrance and/or exit may be maintained at a potential such that ions entering the ion trap are prevented from exiting the ion trap. However, even if ions are prevented from exiting the ion trap at the entrance and/or the exit such an arrangement only constitutes a single axial trapping region. According to the preferred embodiment ions enter the ion trap and even if they are prevented from exiting the ion trap, the ions are not initially fractionated within the ion trap. After a certain delay period though, multiple axial trapping regions are then newly created or formed which preferably fractionate the ions. For the avoidance of any doubt, the term "fractionate" should be understood to mean that ions having different physico-chemical properties are divided into separate fractions wherein all the ions in a particular fraction have similar physico-chemical properties. This is, of course, entirely distinct from fragmentation wherein parent ions collide with gas molecules and dissociate into a plurality of fragment ions.

According to a less preferred embodiment at the first time $t_1$ some shallow axial trapping regions having a first depth may be formed, created or otherwise exist along at least a portion of the length of the ion trap. However, at the second later time $t_2$ the axial trapping regions which are formed or created have a substantially greater second depth. The shallow trapping regions present at time $t_1$ which may provide only a very limited trapping effect are then effectively switched fully ON to become far more effective trapping regions. The second depth may, for example, be preferably at least x % deeper than the first depth, wherein x is selected from the group consisting of (i) 1%; (ii) 2%: (iii) 5%; (iv) 10%; (v) 20%; (vi) 30%; (vii) 40%; (viii) 50%; (iv) 60%; (x) 70%; (xi) 80%; (xii) 90%; (xiii) 100%; (xiv) 150%; (xv) 200%; (xvi) 250%; (xvii) 300%.

The ion trap preferably has an entrance for receiving ions and an exit from which ions exit in use and wherein at the second time $t_2$ when axial trapping regions are formed or created at least some ions (e.g. ions having the lowest mass to charge ratios or highest ion mobilities) will preferably have travelled from the entrance at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion trap towards the exit.

The difference between $t_2$ and $t_1$ i.e the delay time between ions first entering the ion trap and a plurality of axial trapping regions first substantially appearing (which preferably fractionate the ions) is preferably 1–100 μs, 100–200 μs, 200–300 μs, 300–400 μs, 400–500 μs, 500–600 μs, 600–700 μs, 700–800 μs, 800–900 μs or 900–1000 μs. According to another embodiment the difference between $t_2$ and $t_1$ is preferably in the range 1–2 ms, 2–3 ms, 3–4 ms, 4–5 ms, 5–6 ms, 6–7 ms, 7–8 ms, 8–9 ms, 9–10 ms, 10–11 ms, 11–12 ms, 12–13 ms, 13–14 ms, 14–15 ms, 15–16 ms, 16–17 ms, 17–18 ms, 18–19 ms, 19–20 ms, 20–21 ms, 21–22 ms, 22–23 ms, 23–24 ms, 24–25 ms, 25–26 ms, 26–27 ms, 27–28 ms, 28–29 ms, 29–30 ms, or >30 ms.

According to another aspect of the present invention there is provided a mass spectrometer comprising:

an ion trap comprising a plurality of electrodes, wherein in use ions received within the ion trap are trapped in one or more axial trapping regions within the ion trap and wherein the one or more axial trapping regions are translated along at least a portion of the axial length of the ion trap with an initial first velocity and wherein in a mode of operation the first velocity is progressively reduced to a velocity less than 50 m/s. The first velocity is preferably progressively reduced to a velocity less than or equal to 40 m/s, 30 m/s, 20 m/s, 10 m/s, 5 m/s or substantially zero.

According to another aspect of the present invention there is provided a mass spectrometer comprising:

an ion trap comprising a plurality of electrodes, wherein in use ions received within the ion trap are trapped in one or more axial trapping regions within the ion trap and wherein the one or more axial trapping regions are translated along at least a portion of the axial length of the ion trap with an initial first velocity and wherein the first velocity is progressively reduced to substantially zero.

A device for temporally, spatially or otherwise dispersing a group of ions according to a physico-chemical property is preferably provided. The device is preferably arranged upstream of the ion trap. The physico-chemical property may, for example, be mass to charge ratio.

A field free region may be arranged upstream of the ion trap wherein ions which have been accelerated to have substantially the same kinetic energy become dispersed according to their mass to charge ratio. The field free region may be provided within an ion guide. The ion guide may comprise a quadrupole rod set, a hexapole rod set, an octopole or higher order rod set, an ion tunnel ion guide comprising a plurality of electrodes having apertures through which ions are transmitted (the apertures being substantially the same size), an ion funnel ion guide comprising a plurality of electrodes having apertures through which ions are transmitted (the apertures becoming progressively smaller or larger), or a segmented rod set.

A pulsed ion source may be provided wherein in use a packet of ions emitted by the pulsed ion source enters the field free region.

Additionally and/or alternatively, an ion trap may be arranged upstream of the field free region wherein in use the ion trap releases a packet of ions which enters the field free region.

According to another embodiment ions may be arranged to become temporarily or spatially dispersed according to their ion mobility in the gas phase.

A drift region may be arranged, for example, upstream of the ion trap wherein ions become dispersed according to their ion mobility. The drift region may be provided within an ion guide. The ion guide may comprise a quadrupole rod set, a hexapole rod set, an octopole or higher order rod set, an ion tunnel ion guide comprising a plurality of electrodes having apertures through which ions are transmitted (the apertures being substantially the same size), an ion funnel ion guide comprising a plurality of electrodes having apertures through which ions are transmitted (the apertures becoming progressively smaller or larger), or a segmented rod set.

A pulsed ion source may be provided wherein in use a packet of ions emitted by the pulsed ion source enters the drift region.

Alternatively and/or additionally, an ion trap may be arranged upstream of the drift region wherein in use the ion trap releases a packet of ions which enters the drift region.

The ion trap preferably has an entrance for receiving ions and an exit disposed at the other end of the ion trap to the entrance and wherein at a point in time the one or more axial trapping regions may be translated towards the entrance.

The ion trap preferably has an entrance for receiving ions and an exit disposed at the other end of the ion trap to the entrance and wherein at a point in time the one or more axial trapping regions may be translated towards the exit.

A potential barrier between two or more trapping regions may be removed so that the two or more trapping regions form a single trapping region or a potential barrier between two or more trapping regions may be lowered so that at least some ions are able to be move between the two or more trapping regions.

In use, one or more transient DC voltages or one or more transient DC voltage waveforms may be progressively applied to the electrodes so that ions are urged along the ion trap.

In use an axial voltage gradient may be maintained along at least a portion of the length of the ion trap and the axial voltage gradient preferably varies with time.

The ion trap may comprise a first electrode held at a first reference potential, a second electrode held at a second reference potential, and a third electrode held at a third reference potential, wherein at a time $T_1$ a first DC voltage is supplied to the first electrode so that the first electrode is held at a first potential above or below the first reference potential. At a later time $T_2$ a second DC voltage is supplied to the second electrode so that the second electrode is held at a second potential above or below the second reference potential. At a yet later time $T_3$ a third DC voltage is supplied to the third electrode so that the third electrode is held at a third potential above or below the third reference potential.

At the time $T_1$ the second electrode may be at the second reference potential and the third electrode may be at the third reference potential. At the time $T_2$ the first electrode may be at the first potential and the third electrode may be at the third reference potential. At the time $T_3$ the first electrode may be at the first potential and the second electrode may be at the second potential.

According to another embodiment, at the tine $T_1$ the second electrode may be at the second reference potential and the third electrode is at the third reference potential. At the time $T_2$ the first electrode is preferably no longer supplied with the first DC voltage so that the first electrode is returned to the first reference potential and the third electrode is at the third reference potential. At the time $T_3$ the second electrode is preferably no longer supplied with the second DC voltage so that the second electrode is returned to the second reference potential and the first electrode is at the first reference potential.

The first, second and third reference potentials may be substantially the same and/or the first, second and third DC voltages may be substantially the same and/or the first, second and third potentials may be substantially the same.

The ion trap may comprise 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment preferably comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are preferably maintained at substantially the same DC potential. A plurality of segments may be maintained at substantially the same DC potential. Each segment may be maintained at substantially the same DC potential as the subsequent nth segment wherein n is 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30.

Ions may be confined radially within the ion trap by an AC or RF electric field. Ions may be radially confined within the ion trap in a pseudo-potential well and may be constrained axially by a real potential barrier or well.

The transit time of ions through the ion trap (i.e. the time taken for ions to be stored and then released) is preferably less than or equal to 20 ms, less than or equal to 10 ms, less than or equal to 5 ms, less than or equal to 1 ms, or less than or equal to 0.5 ms.

The ion trap and/or a drift region upstream of the ion trap are preferably maintained, in use, at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

The ion trap and/or the drift region preferably is maintained, in use, at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

The ion trap and/or the drift region preferably is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

The ion trap and/or the drift region preferably are maintained, in use, at a pressure such that a viscous drag is imposed upon ions passing through the ion trap and/or drift region.

The field free region is preferably maintained, in use, at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

The field free region is preferably maintained, in use, at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

The field free region is preferably maintained, in use, at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

In use one or more transient DC voltages or one or more transient DC voltage waveforms are preferably applied to electrodes at a first axial position along the ion trap and are then subsequently provided at second, then third different axial positions along the ion trap.

In use one or more transient DC voltages or one or more transient DC voltage waveforms preferably are arranged to move from one end of the ion trap to another end of the ion trap so that ions are urged along the ion trap. The one or more transient DC voltages or one or more transient DC voltage waveforms are preferably arranged to be progressively applied to the ion trap and along the ion trap so that ions are urged along the ion trap.

The one or more transient DC voltages preferably create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage waveforms preferably comprise a repeating waveform, e.g. a square wave.

The amplitude of the one or more transient DC voltages or the one or more transient DC voltage waveforms may remain substantially constant with time or the amplitude of the one or more transient DC voltages or the one or more transient DC voltage waveforms may vary with time.

The amplitude of the one or more transient DC voltages or the one or more transient DC voltage waveforms may either increase with time, increase then decrease with time, decrease with time, or decrease then increase with time.

The ion trap may comprise an upstream entrance region, a downstream exit region and an intermediate region, wherein in the entrance region the amplitude of the one or more transient DC voltages or the one or more transient DC voltage waveforms may have a first amplitude. In the intermediate region the amplitude of the one or more transient DC voltages or the one or more transient DC voltage waveforms may have a second amplitude. In the exit region the amplitude of the one or more transient DC voltages or one or more transient DC voltage waveforms may have a third amplitude.

The entrance and/or exit region preferably comprise a proportion of the total axial length of the ion trap selected from the group consisting of: (i) <5%; (ii) 5–10%; (iii) 10–15%; (iv) 15–20%; (v) 20–25%; (vi) 25–30%; (vii) 30–35%; (viii) 35–40%; and (ix) 40–45%.

The first and/or third amplitudes preferably are substantially zero and the second amplitude is substantially non-zero. The second amplitude preferably is larger than the first amplitude and/or the second amplitude preferably is larger than the third amplitude.

The one or more axial trapping regions may be translated along the ion trap with a first velocity and cause ions within the ion trap to pass along the ion trap with a second velocity.

The difference between the first velocity and the second velocity is selected preferably from the group consisting of: (i) less than or equal to 50 m/s; (ii) less than or equal to 40 m/s; (iii) less than or equal to 30 m/s; (iv) less than or equal to 20 m/s; (v) less than or equal to 10 m/s; (vi) less than or equal to 5 m/s; and (vii) less than or equal to 1 m/s.

The first velocity preferably is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

The second velocity preferably is selected from the group consisting of: (i) 10–250 m/s; (ii) 250–500 m/s; (iii) 500–750 m/s; (iv) 750–1000 m/s; (V) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

The second velocity is preferably substantially the same as the first velocity.

The one or more transient DC voltages or the one or more transient DC voltage waveforms passed along the ion trap or applied to the electrodes preferably have a frequency, and wherein the frequency remains substantially constant, varies, increases, increases then decreases, decreases, or decreases then increases.

The one or more transient DC voltages or the one or more transient DC voltage waveforms passed along the ion trap or applied to the electrodes preferably have a wavelength, and wherein the wavelength, remains substantially constant, varies, increases, increases then decreases, decreases, or decreases then increases.

Two or more transient DC voltages or two or more transient DC voltage waveforms may be arranged to be applied to the electrodes or passed substantially simultaneously along the ion trap. The two or more transient DC voltages or the two or more transient DC voltage waveforms may be arranged to move in the same direction, in opposite directions, towards each other or away from each other.

The one or more transient DC voltages or the one or more transient DC voltage waveforms may be repeatedly generated and applied to the electrodes or passed in use along the ion trap, and wherein the frequency of generating the one or more transient DC voltages or the one or more transient DC voltage waveforms, remains substantially constant, varies, increases, increases then decreases, decreases, or decreases then increases.

The mass spectrometer preferably further comprises a Time of Flight mass analyser comprising an electrode for injecting ions into a drift region, the electrode being arranged to be energised in use in a substantially synchronised manner with a pulse of ions emitted from the exit of the ion trap.

The ion trap may comprise an ion funnel comprising a plurality of electrodes having apertures therein through which ions are transmitted, wherein the diameter of the apertures becomes progressively smaller or larger, an ion tunnel comprising a plurality of electrodes having apertures therein through which ions are transmitted, wherein the diameter of the apertures are substantially constant or a stack of plate, ring or wire loop electrodes.

The ion trap preferably comprises a plurality of electrodes, wherein at least 10%, 20%, 30%, 40%, 50%, 60%, 70%, 80%, 90%, 95% or 100% of the electrodes have an aperture, preferably circular, through which ions are transmitted in use. Each electrode preferably has a single aperture through which ions are transmitted in use, although according to other embodiments multiple apertures may be provided.

The diameter of the apertures of at least 50%, 60%, 70%, 80%, 90%, 95% or 100% of the electrodes forming the ion trap is preferably selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

At least 50%, 60%, 70%, 80%, 90%, 95% or 100% of the electrodes forming the ion trap preferably have apertures which are substantially the same size or area.

According to another embodiment the ion trap may comprise a segmented rod set.

The ion trap may consist of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes. According to a less preferred embodiment the ion trap may comprise <10 electrodes.

The thickness of at least 50%, 60%, 70%, 80%, 90%, 95% or 100% of the electrodes forming the ion trap preferably is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

The ion trap preferably has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

At least 10%, 20%, 30%, 40%, 50%, 60%, 70%, 80%, 90%, 95% or 100% of the electrodes preferably are connected to both a DC and an AC or RF voltage supply.

Axially adjacent electrodes are preferably supplied with AC or RF voltages having a phase difference of 180°. According to an embodiment one or more AC or RF voltage waveforms may be applied to at least some of the electrodes so that ions are urged along at least a portion of the length of the ion trap. This may be in addition to or instead of applying DC voltages to the ion trap to form axial trapping regions.

The mass spectrometer may comprise an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) an Inductively Coupled Plasma ("ICP") ion source; (v) an Electron Impact ("EI) ion source; (vi) an Chemical Ionisation ("CI") ion source; (vii) a Fast Atom Bombardment ("FAB") ion source; (viii) a Liquid Secondary Ions Mass spectrometry ("LSIMS") ion source; (ix) a Matrix Assisted Laser Desorption Ionisation ("MALDI") ion source; and (x) a Laser Desorption Ionisation ("LDI") ion source.

The one or more transient DC voltages or the one or more transient DC voltage waveforms may pass in use along the ion trap with a velocity which remains substantially constant, varies, increases, increases then decreases, decreases, decreases then increases, reduces to substantially zero, reverses direction, or reduces to substantially zero and then reverses direction.

In use pulses of ions preferably emerge from an exit (or entrance) of the ion trap.

A complex mixture of ions may be trapped within the ion trap in use. The complex mixture may comprise, for example, at least 5, 10, 15, 20, 25, 30, 35, 40, 50, 55, 60, 65, 70, 75, 80, 90, 95, 100, 150, 200, 250, 300, 350, 400, 450, 500, 550, 600, 650, 700, 750, 800, 850, 900, 950 or 1000 different species of ions, each species of ions having a substantially different mass to charge ratio.

A Matrix Assisted Laser Desorption Ionisation (MALDI) ion source is particularly preferred.

According to the preferred embodiment, a complex mixture of ions is fractionated in use along the length of the ion trap and one or more fractions are stored in separate axial trapping regions.

Ions may be ejected or allowed to exit from one or more axial trapping regions as desired for subsequent mass analysis or for further experimentation such as fragmentation and/or mass to charge ratio separation and/or ion mobility separation.

According to another aspect of the present invention there is provided a method of mass spectrometry comprising:

providing an ion trap comprising a plurality of electrodes wherein at a first time $t_1$ ions enter the ion trap; and forming or creating one or more axial trapping regions at a second later time $t_2$ along at least a portion of the length of the ion trap.

According to another aspect of the present invention there is provided a method of mass spectrometry comprising:

providing an ion trap comprising a plurality of electrodes;

receiving ions within the ion trap;

trapping the ions in one or more axial trapping regions within the ion trap;

translating the one or more axial trapping regions along at least a portion of the axial length of the ion trap with an initial first velocity; and progressively reducing the first velocity to a velocity less than or equal to 50 m/s.

According to another aspect of the present invention there is provided a method of mass spectrometry comprising:

providing an ion trap comprising a plurality of electrodes;

receiving ions within the ion trap;

trapping the ions in one or more axial trapping regions within the ion trap;

translating the one or more axial trapping regions along at least a portion of the axial length of the ion trap with an initial first velocity; and progressively reducing the first velocity to substantially zero.

BRIEF DESCRIPTION OF THE DRAWINGS

Various embodiments of the present invention will now be described, by way of example only, and with reference to the accompanying drawings in which.

DETAILED DESCRIPTION OF THE INVENTION

Figure 1:
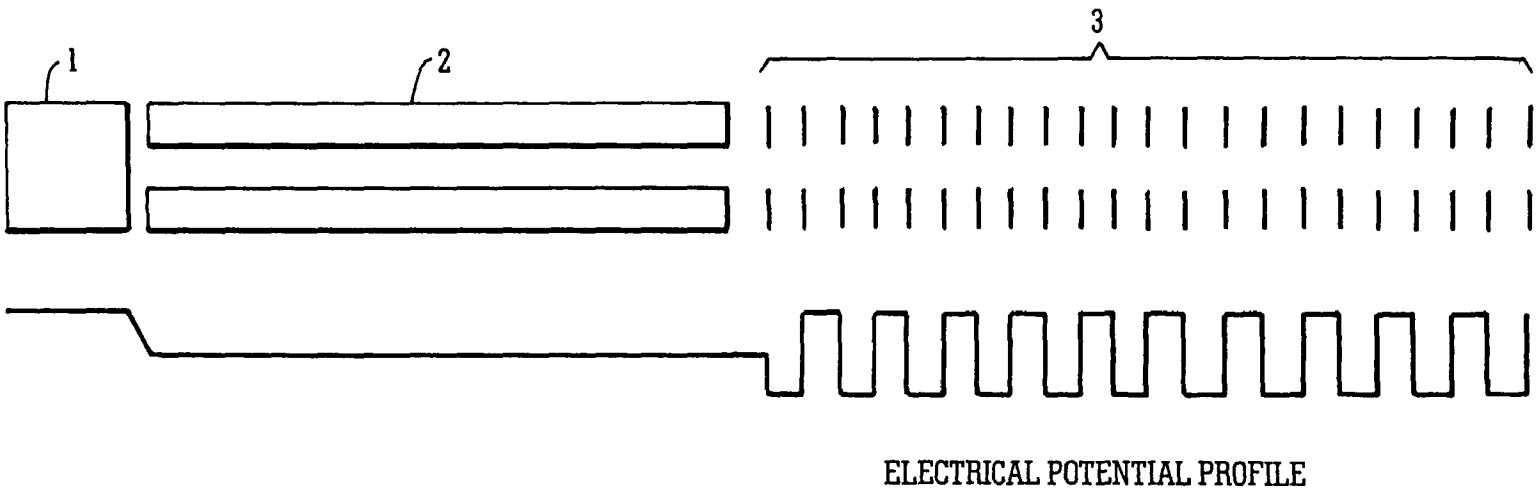
FIG. 1 shows an embodiment wherein ions emitted from an ion source are dispersed according to their mass to charge ratio in a field free region before entering an AC or RF ion trap according to the preferred embodiment.

A preferred embodiment will now be described with reference to FIG. 1. Ions may be released from e.g. a pulsed ion source 1 such as a laser ablation or a Matrix Assisted Laser Desorption/Ionisation (MALDI) ion source 1. Alternatively, a pulse of ions may be released from an ion trap (not shown). The pulse of ions is then preferably accelerated through a constant potential difference so that the ions gain a constant energy. The ions are then preferably transmitted to a field free region 2 which is preferably maintained at a relatively low pressure (e.g. $<10^{-4}$ mbar). Ions having different mass to charge ratios will travel through the field free region 2 at different velocities and the ions will therefore become temporally dispersed according to their mass to charge ratios.

The ions upon reaching the end of the field free region 2 are then arranged to exit the field free region 2 and enter an AC or RF ion guide/ion trap 3 operated according to the preferred embodiment. Ions having relatively low mass to charge ratios will have acquired relatively high velocities in the field free region 2 and hence will have arrived at the AC or RF ion guide/ion trap 3 before other ions having relatively high mass to charge ratios (and which will have had relatively low velocities through the field free region 2). Once the ions emitted from the field free region 2 have entered the AC or RF ion guide/ion trap 3 and have travelled some way along the AC or RF ion guide/ion trap 3, DC potentials are then applied to at least some of the electrodes forming the AC or RF ion guide/ion trap 3 so that a plurality of axial trapping regions are effectively instantaneously created or generated along the length of the AC or RF ion guide/ion trap 3. The ions thus become collected in (real) axial potential wells which are formed along the length of the AC or RF ion guide/ion trap 3. The ions are also radially confined within the AC or RF ion guide/ion trap 3 in pseudo-potential wells by the AC or RF voltage applied to the electrodes forming the AC or RF ion guide/ion trap 3. The effect of creating or forming a plurality of axial trapping regions after a certain delay period following ions first entering the AC or RF ion guide/ion trap 3 is such that the ions will be collected in groups or will be otherwise fractionated according to their mass to charge ratio.

The ions once fractionated are then stored in the various axial trapping regions formed within and along the AC or RF ion guide/ion trap 3 and can then be released in a controlled manner for subsequent analysis or further experimentation. Advantageously, since all the ions in a particular axial trapping region will have a relatively narrow spread of mass to charge ratios then the ions released from a particular axial trapping region can be arranged to be passed to a mass analyser and be mass analysed by, for example, an orthogonal acceleration Time of Flight mass analyser with a relatively high duty cycle. The relatively narrow spread of mass to charge ratios of ions in a particular trapping region may preferably ensure that essentially all the ions will be present in an orthogonal or other extraction region of a Time of Flight mass analyser at substantially the same time when an extraction pulse is applied to the ions in the extraction region. The high duty cycle achievable when operating the preferred ion trap in conjunction with, for example, an orthogonal acceleration Time of Flight mass analyser is particularly advantageous.

The temporal separation of ions according to their mass to charge ratios before arrival at the AC or RF ion guide/ion trap 3 preferably occurs in a field free region 2 which is preferably formed within an ion guide. The ion guide preferably comprises an AC or RF ion guide such as a multipole rod set e.g. a quadrupole or hexapole rod set with zero axial DC electric field. Alternatively, the ion guide may comprises a ring stack or ion tunnel ion guide comprising a plurality of electrodes having apertures through which ions are transmitted in use and again preferably with zero average axial DC electric field. According to less preferred embodiments, other ion guides such as those employing guide wires may also be used.

According to a slightly less preferred but nonetheless still important embodiment, the field free region 2 may be replaced with a drift region maintained at a relatively higher pressure e.g. at least $10^{-3}$ mbar. Ions are preferably urged through the relatively high pressure drift region by e.g. an axial DC voltage gradient or by means of DC and/or AC/RF voltages being applied to electrodes surrounding the drift region which cause axial trapping regions to be created and then translated along the drift region so as to urge ion through the drift region. The ions preferably separate according to their ion mobility in the presence of the relative high pressure background gas and hence more mobile ions reach the end of the drift region before less mobile ions.

The preferred ion trap 3 may be operated in two main different modes of operation. According to a first main mode of operation which has already been briefly described above ions arrive and are received within the AC or RF ion guide/ion trap 3. The ions effectively occupy different positions along the length of the AC or RF ion guide/ion trap 3 according to their mass to charge ratios (or less preferably their ion mobility). No significant axial trapping regions are preferably provided when ions initially enter the AC or RF ion guide/ion trap 3. Ions with relatively low mass to charge ratios (or less preferably relatively high ion mobilities) will preferably have travelled further into the AC or RF ion guide/ion trap 3 than ions having relatively high mass to charge ratios (or less preferably relatively low ion mobilities). Once ions have been received within the AC or RF ion guide/ion trap 3 a series of DC voltages is then applied to certain electrodes forming the AC or RF ion guide/ion trap 3 so that a series of real axial potential wells or barriers are created along the length of the AC or RF ion guide/ion trap 3. For example, a DC potential may be applied to one or more electrodes along the AC or RF ion guide/ion trap 3 so as to form a potential hill. The potential hill may be repeated at regular intervals along the length of the AC or RF ion guide/ion trap 3 so as to create a repeating pattern of potential wells separated by potential hills. The potential wells or barriers may according to less preferred embodiments be spaced at non-regular intervals.

The height of the potential hills (or depth of the potential wells) is preferably arranged so as to trap ions positioned between neighbouring potential hills or wells so that ions are trapped or otherwise stored in the different potential wells or trapping regions along the length of the AC or RF ion guide/ion trap 3. Ions are therefore preferably fractionated according to their mass to charge ratio (or less preferably according to their ion nobility in the gas phase).

Ions may oscillate within each potential well or axial trapping region but according to the preferred embodiment the ions may be subsequently dampened by the introduction of a gas into the AC or RF ion guide/ion trap 3 once some or all the axial trapping regions have been created. The damping gas may, for example, be provided at a pressure of at least $10^{-3}$ bar. The introduction of a gas into the AC or RF ion guide/ion trap 3 will result in collisions between the ions and the gas molecules so that ions will lose energy through such collisions. The energy of the ions within the AC or RF ion guide/ion trap 3 will therefore preferably be reduced to that of the background gas within the AC or RF ion guide/ion trap 3 i.e. the ions will become thermalised. As the ions lose energy they will also tend to occupy the lowest positions within the potential wells and hence will become more radially confined and will occupy average positions closer to the axis of the AC or RF ion guide/ion trap 3. The collisionally cooled ions preferably remain stored in the potential wells or axial trapping regions until it is desired to release the ions either for subsequent mass analysis or for subsequent experimentation (e.g. fragmentation).

Figure 2:
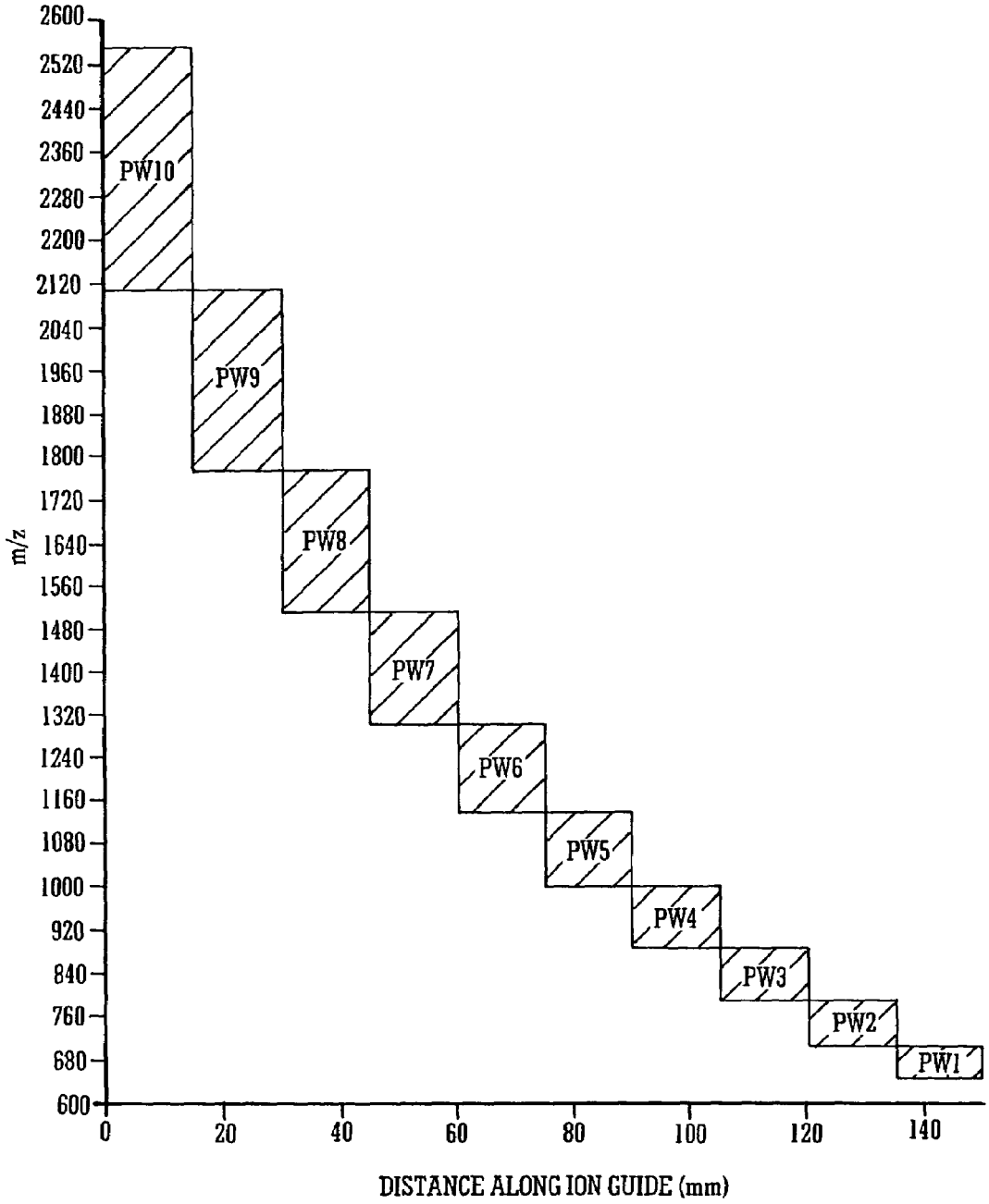
FIG. 2 shows the distribution of ions having various mass to charge ratios as a function of distance along the ion trap according to a first main mode of operation wherein ions enter an AC or RF ion trap and then after a delay time DC potentials are applied to the electrodes forming the ion guide/trap in order to generate a plurality of axial trapping regions which fractionate the ions within the ion guide/trap.

FIG. 2 illustrates how ions having different mass to charge ratios will be distributed along the length of the AC or RF ion guide/ion trap 3 according to the first main mode of operation at the point in time when axial trapping potentials are applied to the AC or RF ion guide/ion trap 3 subsequent to ions having been separated according to their mass to charge ratio being received within the AC or RF ion guide/ion trap 3. In the example illustrated by FIG. 2, the length $L_1$ of the upstream ion guide 2 which provides the field free region 2 is 150 mm and the length $L_2$ of the AC or RF ion guide/ion trap 3 to which trapping DC potentials are applied after a certain delay time is also 150 mm. The DC voltages applied to the AC or RF ion guide/ion trap 3 are such that according to the embodiment described in relation to FIG. 2 ten axial potential wells are formed along the length of the AC or RF ion guide/ion trap 3. The axial potential wells are spaced at regular intervals of 15 mm e.g. the potential barriers are located at 0, 15, 30, 45, 60, 75, 90, 105, 120, 135 and 150 mm from the entrance. The ion energy was assumed to be 3 eV and the trapping potentials along the AC or RF ion guide/ion trap 3 were assumed to be applied some 315 μs after a pulse of ions first entered the field free region 2. In this illustration the ions collected in the (tenth) potential well PW10 which is the potential well closest to the entrance of the AC or RF ion guide/ion trap 3 (i.e. in the region 0–15 mm from the entrance of the ion trap 3) will have ions having mass to charge ratios in the range 2100–2550. Ions collected in the first potential well PW1 furthest from the entrance to the ion guide 3 (i.e. in the region 135–150 mm from the entrance of the ion trap 3) will have ions having mass to charge ratios in the range 640–700. FIG. 2 also illustrates the range of mass to charge ratios of ions trapped in the other intermediate potential wells PW2–PW9.

Figure 3:
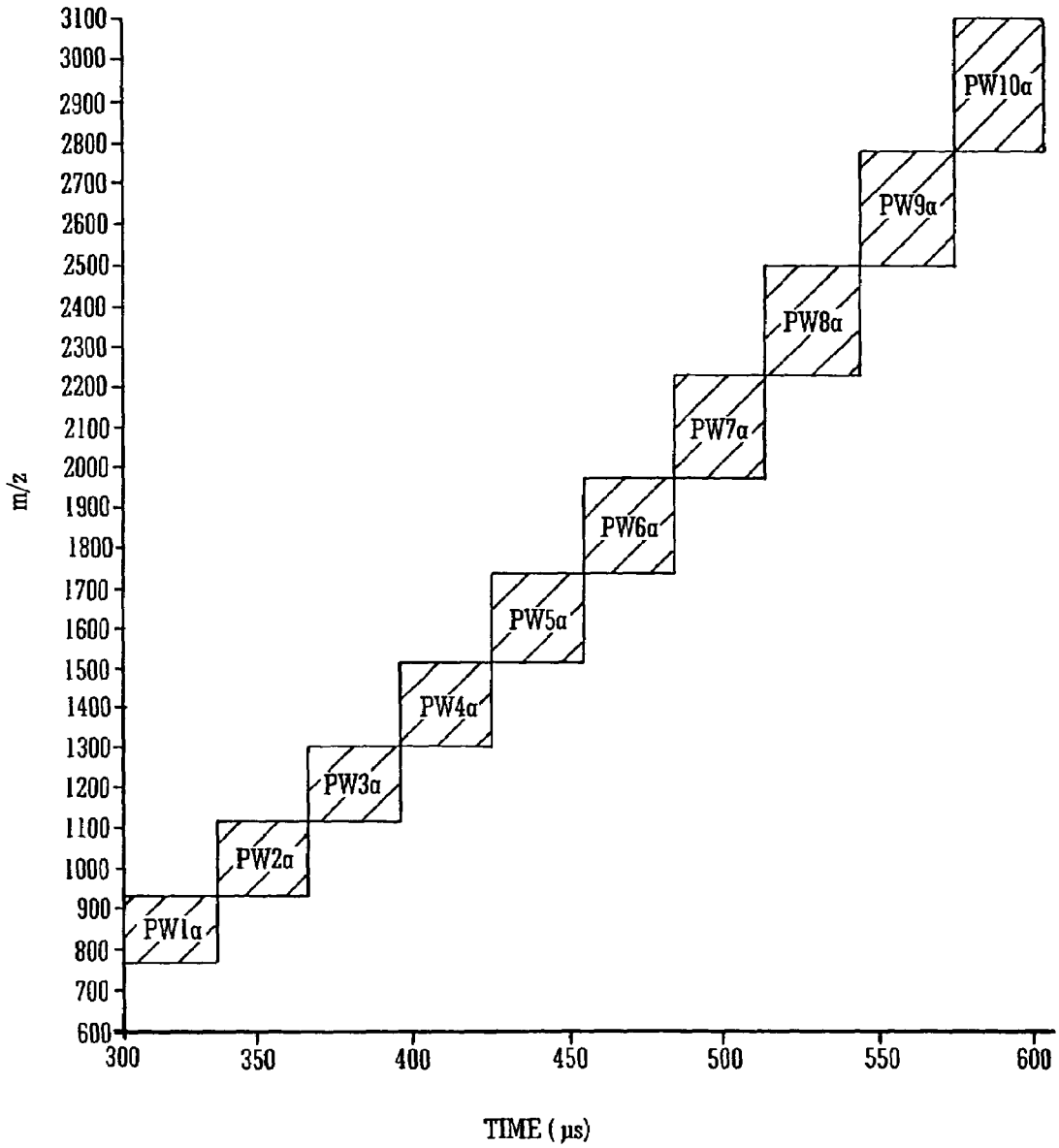
FIG. 3 shows the distribution of ions having various mass to charge ratios as a function of time according to a second main mode of operation wherein ions are received within the ion trap and wherein a plurality of axial trapping regions are translated along the length of the ion trap at progressively slower speeds.

According to a second main mode of operation, described with reference to FIG. 3, the ions may arrive at the AC or RF ion guide/ion trap 3 on which a travelling DC potential voltage or voltage waveform has been superimposed i.e. axial trapping DC potentials are not created after a delay period after ions enter the AC or RF ion guide/ion trap 3, but rather a series of DC potentials are applied to the AC or RF ion guide/ion trap 3 so that a series of axial ion trapping regions are being continuously created and are being translated along the length of the AC or RF ion guide/ion trap 3 as ions arrive. As the ions arrive at the entrance to the AC or RF ion guide/ion trap 3 they are preferably arranged to coincide with the appearance of a first potential well PW1*a* which is being translated in the same direction as the ions. These ions will therefore be translated along the AC or RF ion guide/ion trap 3 within the first potential well PW1*a*. Ions with slightly higher mass to charge ratios (or less preferably slightly lower ion mobilities) will arrive at the AC or RF ion guide/ion trap 3 at a slightly later time but will still travel within the first potential well PW1*a*. However, after a relatively short period of time (30 μs) a second (new) potential hill or barrier will emerge in the vicinity of the entrance of the AC or RF ion guide/ion trap 3 to form a second axial trapping region PW2*a*. This axial trapping region PW2*a* will also be travelling in the same direction as the ions. Ions arriving after the second potential hill has been created will therefore be prevented from being collected and trapped within the first axial trapping region PW1*a* and hence will therefore be collected and travel within the second axial trapping region PW2*a*. Third and further potential wells or axial trapping regions PW3*a*–PW10*a* are preferably created as ions continue to arrive at the AC or RF ion guide/ion trap 3.

As will be appreciated, each new potential well or axial trapping region will therefore collect a series of ions with an average range of mass to charge ratios slightly higher than the previous potential well (or less preferably ion mobilities slightly lower than the previous potential well). Ions may oscillate within each potential well or axial trapping region but their ion motion may preferably be subsequently dampened by the introduction of a gas into the AC or RF ion guide/ion trap 3.

The axial length of the potential wells which are preferably created along the length of the AC or RF ion guide/ion trap 3 may be varied so that the range of mass to charge ratios (or less preferably ion mobilities) that are collected in each potential well can be arranged as desired. FIG. 3 shows the range of ions collected in each of the axial trapping regions over the period 300–600 μs subsequent to ions first entering the field free region 2. A new ion trapping region is created every 30 μs after 300 μs have elapsed. The axial trapping regions are translated with a constant velocity and have a constant axial length. In the example illustrated by FIG. 3 the length of the field free region $L_1$ and the length of the AC or RF ion trap 3 are both 150 mm. Axial trapping regions are created having a length of 15 mm. The ion energy was assumed to be 1 eV in this particular example. Ions collected in the first potential well PW1*a* (during the period 300–330 μs) have mass to charge ratios in the range 780–920. Ions collected in the last potential well PW10*a* (during the time period 570–600 μs) have mass to charge ratios in the range 2790–3100. In the example shown in FIG. 3 further potential wells or axial trapping regions are generated after 330 μs, 360 μs, 390 μs, 420 μs, 450 μs, 480 μs, 510 μs, 540 μs and 570 μs.

According to a particularly preferred embodiment described in more detail below the velocity that the axial trapping regions are translated along the AC or RF ion trap 3 may progressively slow down to substantially match the ever decreasing velocity of the ions arriving at the entrance of the AC or RF ion guide/ion trap 3. The velocity of ions already trapped in the potential wells or axial trapping regions being translated along the AC or RF ion guide/ion trap 3 will also preferably decrease to match that of the axial trapping regions. Ion motion may be dampened by the presence or introduction of a buffer gas into the AC or RF ion guide/ion trap 3. Under the right conditions the velocity of the ions in the axial trapping regions can be made to decrease at the same rate as that of the axial trapping regions.

In the following analysis it is assumed that ions are released from a pulsed ion source 1, for example a laser ablation or MALDI ion source, or are released from an ion trap. Ions then travel through an AC or RF ion guide 2 with zero axial DC electric field (i.e. a field free region 2) and then enter an AC or RF ion guide/ion trap 3 with a superimposed travelling DC voltage wave or voltage waveform according to the preferred embodiment i.e. axial trapping regions are created and are then translated along the AC or RF ion guide/ion trap 3. The ion guide 2 with zero axial DC electric field is preferably maintained at a relatively low pressure (e.g. less than 0.0001 mbar) and the AC or RF ion guide/ion trap 3 according to the preferred embodiment is preferably maintained at an intermediate pressure (e.g. between 0.0001 and 100 mbar, preferably between 0.001 and 10 mbar).

The distance in meters from the pulsed ion source 1 (or ion trap) to the entrance of the travelling wave AC or RF ion guide/ion trap 3 (i.e. the length of the field free region 2) is $L_1$, the length of the travelling wave AC or RF ion guide/ion trap 3 is $L_2$ and the distance from the exit of the travelling wave AC or RF ion guide/ion trap 3 to the centre of an orthogonal acceleration Time of Flight acceleration region arranged downstream of the AC or RF ion guide/ion trap 3 is $L_3$. The ions are preferably accelerated through a voltage difference of $V_1$ at the ion source (or ion trap) so that they have an energy $E_1$ of $zeV_1$ electron volts upon entering the field free region 2. Accordingly, for ions having a mass to charge ratio m/z the arrival time $T_1$ (in μs) of ions arriving at the entrance to the travelling wave AC or RF ion guide/ion trap 3 after they have entered the field free region 2 is given by:

$$T_1 = 72L_1\sqrt{\frac{m}{zeV_1}}$$

The velocity v of the ions emerging from the field free region 2 and entering the AC or RF ion guide/ion trap 3 will be:

$$v = \frac{L_1}{T_1}$$

The AC or RF ion guide/ion trap 3 is preferably maintained at an intermediate pressure such that the gas density is sufficient to impose a viscous drag on ions entering the AC or RF ion guide/ion trap 3 and hence the gas will appear as a viscous medium to the ions and will act to slow the ions down.

According to the preferred embodiment the velocity $v_{wave}$ of a travelling DC voltage wave or voltage waveform superimposed on the electrodes forming the AC or RF ion guide/ion trap 3 (i.e. the velocity that the axial trapping regions are translated along the AC or RF ion guide/ion trap 3) is arranged to substantially equal the velocity v of the ions arriving at the entrance to the AC or RF ion guide/ion trap 3. Since the velocity of the ions arriving at the entrance to the AC or RF ion guide/ion trap 3 is inversely proportional to the elapsed time $T_1$ from the release of ions from the ion source 1 (or ion trap), then the velocity $v_{wave}$ of the travelling DC voltage wave or the speed at which the axial trapping regions are translated preferably also decreases with time in the same way.

Since the travelling DC voltage wave velocity $v_{wave}$ is equal to $\lambda/T$ where $\lambda$ is the wavelength (or length of an axial trapping region) and T is the cycle time of the DC voltage waveform (or repetition rate at which axial trapping regions are created) then it follows that the cycle time T should also preferably vary in proportion to the elapsed time $T_1$ assuming that the wavelength (i.e. length of the axial trapping regions) is kept constant. Accordingly, for the DC voltage wave velocity to always substantially equal the velocity of the ions arriving at the entrance to the AC or RF ion guide/ion trap 3, the travelling DC voltage wave cycle time T (i.e. the time taken between creating axial trapping regions) should preferably increase substantially is linearly with time.

Since the travelling DC voltage wave velocity $v_{wave}$ (or the velocity of translating the axial trapping regions) preferably continuously slows then it may be thought that the ions might travel faster than the axial trapping region which is slowing down and that the ions might oscillate within the axial trapping region. However, the viscous drag resulting from frequent collisions with gas molecules in the AC or RF ion guide/ion trap 3 preferably prevents the ions from building up excessive velocity. Consequently, the ions will tend to ride on or travel with the travelling DC voltage wave (i.e. with the translating axial trapping regions) rather than run ahead of the travelling DC voltage wave and execute excessive oscillations within the potential wells being translated along the length of the AC or RF ion guide/ion trap 3.

If, in time $\delta t$, the ions travel a distance $\delta l$ within the AC or RF ion guide/ion trap 3 then:

$$\delta l = v\delta t$$

If the time at which the ions exit the AC or RF ion guide/ion trap 3 is $T_2$ then the distance $\Delta L$ travelled within the AC or RF ion guide/ion trap 3 is:

$$\Delta L = \int_{T_1}^{T_2} v\delta t$$

$$\Delta L = \int_{T_1}^{T_2} \frac{Ll}{t}\delta t$$

$$\Delta L = L_1(\ln(T_2) - \ln(T_1))$$

$$\Delta L = L_1 \ln\left(\frac{T_2}{T_1}\right)$$

Since the length of the AC or RF ion guide/ion trap 3 is $L_2$ and hence $\Delta L = L_2$ then:

$$L_2 = L_1 \ln\left(\frac{T_2}{T_1}\right)$$

$$T_2 = T_1 e^{\left(\frac{L_2}{L_1}\right)}$$

The velocity of the ions $v_x$ as they exit the AC or RF ion guide/ion trap 3 is equal to that of the travelling DC voltage wave (or speed of the axial trapping region) at the time the ions exit the AC or RF ion guide/ion trap 3 which in turn equals the velocity of the ions being received at the entrance to the AC or RF ion guide/ion trap 3 and hence:

$$v_x = \frac{L_1}{T_2}$$

$$v_x = \frac{L_1}{T_1} e^{-\left(\frac{L_2}{L_1}\right)}$$

$$v_x = v e^{-\left(\frac{L_2}{L_1}\right)}$$

Since the energy $E_1$ of the ions entering the AC or RF ion guide/ion trap 3 is:

$$E_1 = zeV_1$$

and since:

$$E_1 = \frac{1}{2}mv^2$$

then if the energy of the ions exiting the AC or RF ion guide/ion trap 3 is $E_2$ then:

$$E_2 = \frac{1}{2}mv_x^2$$

$$E_2 = \frac{1}{2}mv^2 e^{-2\left(\frac{L_2}{L_1}\right)}$$

$$E_2 = E_1 e^{-2\left(\frac{L_2}{L_1}\right)}$$

It is therefore apparent from considering the above equations that when the velocity of travelling DC voltage wave (or axial trapping regions) substantially matches the velocity of the ions arriving at the entrance of the AC or RF ion guide/ion trap 3 then both the energy and the velocity of ions within the axial trapping regions decays substantially exponentially with distance travelled along the length of the AC or RF ion guide/ion trap 3.

The gas in the AC or RF ion guide/ion trap 3 preferably causes frequent ion-molecule collisions which in turn cause the ions in the AC or RF ion guide/ion trap 3 to lose kinetic energy. In the presence of an RE confining field both the axial and radial kinetic energies will therefore be reduced. It has been shown that the axial and radial energies also happen to decay approximately exponentially with distance travelled along an AC or RF ion guide (see J. Am. Soc. Mass Spectrom., 1998, 9, pp 569–579). From computer simulations it is estimated that the kinetic energies of ions in both their axial and radial directions reduce to about 10% of their initial value when ions pass through a nitrogen gas pressure-distance product of approximately 0.1 mbar-cm. Since both the velocity of translating the axial trapping regions and the kinetic energies of ions within the axial trapping regions are preferably arranged to decay exponentially with distance along the AC or RF ion guide/ion trap 3, the exponential decay rate imposed by slowing down the speed of translating the axial trapping regions can be arranged so as to substantially match the inherent decay of the ion kinetic energy with distance due to collisional cooling of the ions with gas molecules within the AC or RF ion guide/ion trap 3. Advantageously, it is therefore possible to arrange for the axial trapping regions to progressively slow down at a rate which substantially equals the collisional cooling of the ions so as to avoid ions gaining excessive energy and being fragmented within the ion guide/ion trap 3.

As the ions enter the AC or RF ion guide/ion trap 3 then the ions will preferably be grouped such that each axial trapping region contains ions having a limited range of mass to charge ratios (or less preferably ion mobilities). Each axial trapping region will have ions with mass to charge ratios higher (or less preferably lower ion mobilities) than those of the preceding axial trapping region. After the last ions of interest have entered the AC or RF ion guide/ion trap 3 the axial trapping regions can then effectively be halted. Further damping of the ion motion may be performed whilst the ions are trapped within the AC or RF ion guide/ion trap 3 and for as long as the buffer gas pressure in the AC or RF ion guide/ion trap 3 is maintained. Ions can then be released from one or more of the ion trapping regions for subsequent analysis or experimentation as desired.

Once ions have been stored and effectively brought to a halt within the ion trap 3 they may then be released from the series of potential wells either from the end to which the ions were originally travelling or according to another embodiment from the entrance of the AC or RF ion guide/ion trap 3. In the former case the ions will be released in increasing order of mass to charge ratio value (or less preferably decreasing ion mobility) starting with those ions having the lowest mass to charge ratios (or less preferably highest ion mobilities). In the latter case ions once trapped are reversed in direction so as to be released from the end of the AC or RF ion guide/ion trap 3 through which they entered. In this case ions will be released in decreasing order of mass to charge ratio (or less preferably increasing ion mobilities) starting with those ions having the highest mass to charge ratios (or less preferably lowest ion mobilities).

Ions may be released, for example, from the AC or RF ion guide/ion trap 3 by lowering the potential hill or barrier retaining the ions within the AC or RF ion guide/ion trap 3 and optionally accelerating the ions out in the required direction. Alternatively, ions may be released by moving the axial trapping region along one wavelength (or axial trapping region spacing) in the required direction. This will push out the ions in the group nearest the exit (or entrance) of the AC or RF ion guide/ion trap 3 and at the same time all the other ions in their respective groups will be translated one wavelength (or axial trapping region spacing) closer to the exit.

The preferred AC or RF ion guide/ion trap 3 according to both the first and second main modes of operation enables a large number of ions from a complex mixture of ions to be subsequently analysed in, for example, a tandem mass spectrometer by means of collision induced fragmentation and subsequent mass analysis of the fragment ions. The preferred AC or RF ion guide/ion trap 3 together with preferably an upstream field free region 2 or drift region enables the components to be separated, or at least partially separated, into groups according to their mass to charge ratio (or less preferably ion mobility)-and then stored in a series of separate potential wells or axial trapping regions. The ions can then be subsequently analysed in groups, one group at a time. According to an embodiment the ions exiting the preferred AC or RF ion guide/ion trap 3 may be mass filtered so that ions having a precise mass to charge ratio from each group may be selected to be fragmented and the resulting fragment ions mass analysed.

Figure 4:
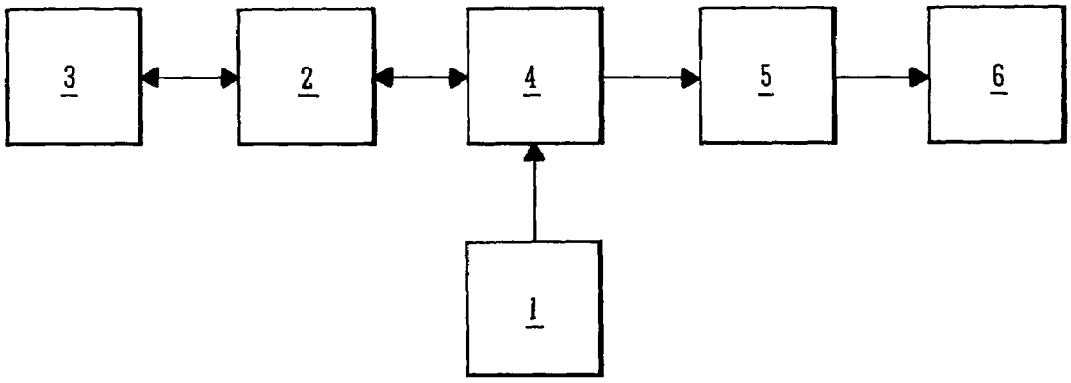
FIG. 4 shows a mass spectrometer incorporating a preferred ion trap.

An embodiment of the present invention will now be described with reference to FIG. 4. A pulse of ions may be emitted from an ion source 1 and collected and cooled in an AC or RF ion trapping device 4. The AC or RF ion trapping device 4 may, for example, comprise a segmented AC or RF ion guide which in a mode of operation functions as an ion trap by virtue of being able to be programmed with different DC potentials along its length. When used to trap ions the AC or RF ion trapping device 4 may be programmed to have an axial potential well at some point along its length. The AC or RF ion trapping device 4 may alternatively comprise a segmented multipole rod set, a stacked ring set, a stacked plate set in the form of a sandwich of electrodes, or some combination of these devices. The AC or RF ion trapping device 4 may use a buffer gas to cool the ions thereby helping to improve the trapping efficiency of the device 4 whilst at the same time cooling energetic ions emitted from the ion source 1.

If it is only required to mass analyse the trapped ions then the ions may be released from the ion trapping device 4 and passed to downstream to an ion guide 5 and further downstream mass analyser 6. The mass analyser 6 may comprise, for example, a quadrupole mass filter, a 2D (linear) or 3D (Paul) quadrupole ion trap, a Time of Flight mass analyser, a FTICR mass analyser or a magnetic sector mass analyser. According to a preferred embodiment the mass analyser comprises an orthogonal acceleration Time of Flight mass analyser.

Alternatively, if it is desired to fragment and analyse a number of different ions from the mixture of ions released from the ion source 1 and subsequently collected and collisionally cooled in the AC or RF ion trapping device 4, then the ions may be released from the AC or RF ion trapping device 4 in a single pulse and passed upstream through an RF quadrupole ion guide 2. The RF quadrupole ion guide 2 is preferably operated in an RF only mode so that it acts as an ion guide not as a mass filter. The RF quadrupole ion guide 2 is preferably operated at a pressure (e.g. $<10^{-4}$ mbar) such that the RF quadrupole ion guide 2 forms a field free region 2 within the ion guide. Ions therefore become temporally separated according to their mass to charge ratio as they pass through the RF quadrupole ion guide. The ions emerging from the field free region 2 within the RF quadrupole ion guide are received by an ion trap 3 operated according to either the first or second main modes of operation. Ions preferably become collected and stored within the ion trap 3 in groups according to their mass to charge ratios as described previously. The ion trap 3 may, for example, be provided with a progressively slowing travelling DC voltage wave as described above with reference to the second main mode of operation of the preferred ion trap 3. Ions therefore enter the ion trap 3 and are received within axial trapping regions which are translated away from the exit of the ion trap 3. Potential barriers are therefore repeatedly created around the entrance region of the ion trap 3 so as to create further ion trapping regions which are similarly translated away from the entrance of the ion trap 3 but preferably with ever decreasing velocity so as to match the decreasing velocity of ions arriving at the ion trap 3. The axial trapping regions are preferably brought to a halt or standstill.

Ions may then be released from the series of potential wells in the preferred ion trap 3 in reverse order i.e. ions having the highest mass to charge ratios which are the last to enter the ion trap 3 and hence are stored in axial trapping regions closest to the entrance of the ion trap 3 may be the first ions to be released from the preferred ion trap 3. Ions in a first group are preferably released from the preferred ion trap 3 and are preferably ejected back through the RF quadrupole ion guide 2 and preferably pass into and through the AC or RF ion trapping device 4. The RF quadrupole ion guide 2 may either be operated in the non-resolving (i.e. RF only) mode such as to transmit all the ions released from an axial trapping region within the preferred ion trap 3. Alternatively, the RF quadrupole ion guide 2 may be operated in the resolving (i.e. mass filtering) mode of operation so as to transmit only ions having a specific or a limited range of mass to charge ratios and to attenuate ions having other mass to charge ratios.

Ions transmitted through the RF quadrupole ion guide 2 and received in the AC or RF ion trapping device 4 may be fragmented by collision activation with a buffer gas within the AC or RF ion trapping device 4. The fragment ions may then preferably be trapped in the AC or RF ion trapping device 4 and may be subsequently released and passed downstream through an optional further ion guide 5 before being passed to a mass analyser 6 arranged downstream of the AC or RF ion trapping device 4 and optional further ion guide 5.

The procedure of releasing ions from the ion trap 3 and optionally fragmenting some or all the parent ions released in a group of ions from an axial trapping region within the preferred ion trap 3 may be repeated multiple times until all the desired ions have been fragmented or mass analysed. The preferred ion trap 3 may therefore be operated as a fraction collection device for fractionating ions according to their mass to charge ratios. The embodiment shown and described in relation to FIG. 4 allows many different fragmentation and mass analyses to be performed from the original mixture of ions and enables a high duty cycle to be obtained especially when the mass spectrometer is operated in a MS/MS mode.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

an ion trap comprising a plurality of electrodes wherein at a first time $t_1$ ions enter said ion trap and wherein at a second later time $t_2$ four or more axial trapping regions are formed or created along at least a portion of the length of said ion trap, and wherein at said second time $t_2$ at least some ions have travelled from said entrance at least 50% of the axial length of said ion trap towards said exit.

2. A mass spectrometer as claimed in claim 1, wherein at said time $t_2$ at least 5, 6, 7, 8, 9, 10, 11, 12, 13, 14, 15, 16, 17, 18, 19, 20, 21, 22, 23, 24, 25, 26, 27, 28, 29, 30 or more than 30 axial trapping regions are created or formed.

3. A mass spectrometer as claimed in claim 1, wherein at said first time $t_1$ in the region intermediate the entrance and exit of said ion trap no axial trapping regions are provided along said ion trap.

4. A mass spectrometer as claimed in claim 1, wherein at said first time $t_1$ one or more axial trapping regions having a first depth are formed, created or exist along at least a portion of the length of said ion trap and wherein at said second later time $t_2$ one or more axial trapping regions are formed or created which have a second depth, wherein said second depth is greater than said first depth.

5. A mass spectrometer as claimed in claim 4, wherein said second depth is at least x % deeper than said first depth, wherein x is selected from the group consisting of (i) 1%; (ii) 2%; (iii) 5%; (iv) 10%; (v) 20%; (vi) 30%; (vii) 40%; (viii) 50%; (iv) 60%; (x) 70%; (xi) 80%; (xii) 90%; (xiii) 100%; (xiv) 150%; (xv) 200%; (xvi) 250%; (xvii) 300%.

6. A mass spectrometer as claimed in claim 1, wherein said ion trap has an entrance for receiving ions and an exit from which ions exit in use and wherein at said second time $t_2$ at least some ions have travelled from said entrance at least 55%, 60%, 65%, 70%, 75%, 80%, 85%, 90%, 95% or 100% of the axial length of said ion trap towards said exit.

7. A mass spectrometer as claimed in claim 1, wherein the difference between $t_2$ and $t_1$ is selected from the group consisting of: (i) 1–100 μs; (ii) 100–200 μs; (iii) 200–300 μs; (iv) 300–400 μs; (v) 400–500 μs; (vi) 500–600 μs; (vii) 600–700 μs; (viii) 700–800 μs; (ix) 800–900 μs; and (x) 900–1000 μs.

8. A mass spectrometer as claimed in claim 1, wherein the difference between $t_2$ and $t_1$ is selected from the group consisting of: (i) 1–2 ms; (ii) 2–3 ms; (iii) 3–4 ms; (iv) 4–5 ms; (v) 5–6 ms; (vi) 6–7 ms; (vii) 7–8 ms; (viii) 8–9 ms; (ix) 9–10 ms; (x) 10–11 ms; (xi) 11–12 ms; (xii) 12–13 ms; (xiii) 13–14 ms; (xiv) 14–15 ms; (xv) 15–16 ms; (xvi) 16–17 ms; (xvii) 17–18 ms; (xviii) 18–19 ms; (xix) 19–20 ms; (xx) 20–21 ms; (xxi) 21–22 ms; (xxii) 22–23 ms; (xxiii) 23–24 ms; (xxiv) 24–25 ms; (xxv) 25–26 ms; (xxvi) 26–27 ms; (xxvii) 27–28 ms; (xxviii) 28–29 ms; (xxix) 29–30 ms; or (xxx) >30 ms.

9. A mass spectrometer comprising:

an ion trap comprising a plurality of electrodes, wherein in use ions received within said ion trap are trapped in one or more axial trapping regions within said ion trap and wherein in a mode of operation said one or more axial trapping regions are translated along at least a portion of the axial length of said ion trap with an initial first velocity and wherein said first velocity is then progressively reduced to a velocity less than or equal to 50 m/s.

10. A mass spectrometer as claimed in claim 9, wherein said first velocity is progressively reduced to a velocity selected from the group consisting of: (i) less than or equal to 40 m/s; (ii) less than or equal to 30 m/s; (iii) less than or equal to 20 m/s; (iv) less than or equal to 10 m/s; (v) less than or equal to 5 m/s; and (vi) substantially zero.

11. A mass spectrometer comprising:

an ion trap comprising a plurality of electrodes, wherein in use ions received within said ion trap are trapped in one or more axial trapping regions within said ion trap and wherein said one or more axial trapping regions are translated along at least a portion of the axial length of said ion trap with an initial first velocity and wherein said first velocity is then progressively reduced to substantially zero.

12. A mass spectrometer as claimed in claim 11, further comprising a device for temporally or spatially dispersing a group of ions according to a physico-chemical property, said device being arranged upstream of said ion trap.

13. A mass spectrometer as claimed in claim 12, wherein said physico-chemical property is mass to charge ratio.

14. A mass spectrometer as claimed in claim 13, wherein said device comprises a field free region wherein, in use, ions which have been accelerated to have substantially the same kinetic energy become dispersed according to their mass to charge ratio.

15. A mass spectrometer as claimed in claim 14, wherein said field free region is provided within an ion guide.

16. A mass spectrometer as claimed in claim 15, wherein said ion guide is selected from the group consisting of: (i) a quadrupole rod set; (ii) a hexapole rod set; (iii) an octopole or higher order rod set; (iv) an ion tunnel ion guide comprising a plurality of electrodes having apertures through which ions are transmitted, said apertures being substantially the same size; (v) an ion funnel ion guide comprising a plurality of electrodes having apertures through which ions are transmitted, said apertures becoming progressively smaller or larger; and (vi) a segmented rod set.

17. A mass spectrometer as claimed in claim 14, wherein said field free region is maintained, in use, at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

18. A mass spectrometer as claimed in claim 14, wherein said field free region is maintained, in use, at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

19. A mass spectrometer as claimed in claim 14, wherein said field free region is maintained, in use, at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

20. A mass spectrometer as claimed in claim 14, further comprising a pulsed ion source wherein in use a packet of ions emitted by said pulsed ion source enters said field free region.

21. A mass spectrometer as claimed in claim 14, further comprising an ion trap arranged upstream of said field free region wherein in use said ion trap releases a packet of ions which enters said field free region.

22. A mass spectrometer as claimed in claim 12, wherein said physico-chemical property is ion mobility.

23. A mass spectrometer as claimed in claim 22, wherein said device comprises a drift region arranged upstream of said ion trap wherein ions become dispersed according to their ion mobility.

24. A mass spectrometer as claimed in claim 23, wherein said drift region is provided within an ion guide.

25. A mass spectrometer as claimed in claim 24, wherein said ion guide is selected from the group consisting of: (i) a quadrupole rod set; (ii) a hexapole rod set; (iii) an octopole or higher order rod set; (iv) an ion tunnel ion guide comprising a plurality of electrodes having apertures through which ions are transmitted, said apertures being substantially the same size; (v) an ion funnel ion guide comprising a plurality of electrodes having apertures through which ions are transmitted, said apertures becoming progressively smaller or larger; and (vi) a segmented rod set.

26. A mass spectrometer as claimed in claim 23, wherein said drift region is maintained, in use, at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

27. A mass spectrometer as claimed in claim 23, wherein said drift region is maintained, in use, at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

28. A mass spectrometer as claimed in claim 23, wherein said drift region is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

29. A mass spectrometer as claimed in claim 23, wherein said drift region is maintained, in use, at a pressure such that a viscous drag is imposed upon ions passing through said drift region.

30. A mass spectrometer as claimed in claim 23, further comprising a pulsed ion source wherein in use a packet of ions emitted by said pulsed ion source enters said drift region.

31. A mass spectrometer as claimed in claims 23, further comprising an ion trap arranged upstream of said drift region wherein in use said ion trap releases a packet of ions which enters said drift region.

32. A mass spectrometer as claimed in claim 12, wherein said physico-chemical property is selected from the group consisting of: (i) elution time, hydrophobicity, hydrophilicity, migration time or chromatographic retention time; (ii) solubility; (iii) molecular volume or size; (iv) net charge, charge state, ionic charge or composite observed charge state; (v) isoelectric point (pI); (vi) dissociation constant (pKa); (vii) antibody affinity; (viii) electrophoretic mobility; (ix) ionisation potential; (x) dipole moment; and (xi) hydrogen-bonding capability or hydrogen-bonding capacity.

33. A mass spectrometer as claimed in claim 11, wherein said ion trap has an entrance for receiving ions and an exit disposed at the other end of said ion trap to said entrance and wherein at a point in time said four or more axial trapping regions are translated towards said entrance.

34. A mass spectrometer as claimed in claim 11, wherein said ion trap has an entrance for receiving ions and an exit disposed at the other end of said ion trap to said entrance and wherein at a point in time said four or more axial trapping regions are translated towards said exit.

35. A mass spectrometer as claimed in claim 11, wherein a potential barrier between two or more axial trapping regions is removed so that said two or more trapping regions form a single trapping region or a potential barrier between two or more axial trapping regions is lowered so that at least some ions are able to be move between said two or more axial trapping regions.

36. A mass spectrometer as claimed in claim 11, wherein in use an axial voltage gradient is maintained along at least a portion of the length of said ion trap and wherein said axial voltage gradient varies with time.

37. A mass spectrometer as claimed in claim 11, wherein said ion trap comprises a first electrode held at a first reference potential, a second electrode held at a second reference potential, and a third electrode held at a third reference potential, wherein:

at a time $T_1$ a first DC voltage is supplied to said first electrode so that said first electrode is held at a first potential above or below said first reference potential;

at a later time $T_2$ a second DC voltage is supplied to said second electrode so that said second electrode is held at a second potential above or below said second reference potential; and at a later time $T_3$ a third DC voltage is supplied to said third electrode so that said third electrode is held at a third potential above or below said third reference potential.

38. A mass spectrometer as claimed in claim 37, wherein:

at said time $T_1$ said second electrode is at said second reference potential and said third electrode is at said third reference potential;

at said time $T_2$ said first electrode is at said first potential and said third electrode is at said third reference potential; and at said time $T_3$ said first electrode is at said first potential and said second electrode is at said second potential.

39. A mass spectrometer as claimed in claim 37, wherein:

at said time $T_1$ said second electrode is at said second reference potential and said third electrode is at said third reference potential;

at said time $T_2$ said first electrode is no longer supplied with said first DC voltage so that said first electrode is returned to said first reference potential and said third electrode is at said third reference potential; and at said time $T_3$ said second electrode is no longer supplied with said second DC voltage so that said second electrode is returned to said second reference potential and said first electrode is at said first reference potential.

40. A mass spectrometer as claimed in claim 37, wherein said first, second and third reference potentials are substantially the same and/or said first, second and third DC voltages are substantially the same and/or said first, second and third potentials are substantially the same.

41. A mass spectrometer as claimed in claim 11, wherein said ion trap comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential.

42. A mass spectrometer as claimed in claim 41, wherein a plurality of segments are maintained at substantially the same DC potential.

43. A mass spectrometer as claimed in claim 41, wherein each segment is maintained at substantially the same DC potential as the subsequent nth segment wherein n is 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30.

44. A mass spectrometer as claimed in claim 11, wherein ions are: (i) radially confined within said ion trap by an AC or RF electric field; or (ii) radially confined within said ion trap in a pseudo-potential well and are constrained axially by a real potential barrier or well.

45. A mass spectrometer as claimed in claim 11, wherein the transit time of ions through said ion trap is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

46. A mass spectrometer as claimed in claim 11, wherein said ion trap is maintained, in use, at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

47. A mass spectrometer as claimed in claim 11, wherein said ion trap is maintained, in use, at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

48. A mass spectrometer as claimed in claim 11, wherein said ion trap is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

49. A mass spectrometer as claimed in claim 11, wherein said ion trap is maintained, in use, at a pressure such that a viscous drag is imposed upon ions passing through or entering said ion trap.

50. A mass spectrometer as claimed in claim 11, wherein in use one or more transient DC voltages or one or more transient DC voltage waveforms are arranged to be progressively applied to the electrodes forming said ion trap so that ions are urged along said ion trap.

51. A mass spectrometer as claimed in claim 50, wherein in use one or more transient DC voltages or one or more transient DC voltage waveforms are applied to said electrodes at a first axial position along said ion trap and are then subsequently provided at second, then third different axial positions along said ion trap.

52. A mass spectrometer as claimed in claim 50, wherein said one of more transient DC voltages create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

53. A mass spectrometer as claimed in claim 50, wherein said one or more transient DC voltage waveforms comprise a repeating waveform.

54. A mass spectrometer as claimed in claim 53, wherein said one or more transient DC voltage waveforms comprise a square wave.

55. A mass spectrometer as claimed in claim 50, wherein either: (i) the amplitude of said one or more transient DC voltages or said one or more transient DC voltage waveforms remains substantially constant with time; or (ii) the amplitude of said one or more transient DC voltages or said one or more transient DC voltage waveforms varies with time.

56. A mass spectrometer as claimed in claim 50, wherein the amplitude of said one or more transient DC voltages or said one or more transient DC voltage waveforms either: (i) increases with time; (ii) increases then decreases with time; (iii) decreases with time; or (iv) decreases then increases with time.

57. A mass spectrometer as claimed in claims 50, wherein said ion trap comprises an upstream entrance region, a downstream exit region and an intermediate region, wherein:

in said entrance region the amplitude of said one or more transient DC voltages or said one or more transient DC voltage waveforms has a first amplitude;

in said intermediate region the amplitude of said one or more transient DC voltages or said one or more transient DC voltage waveforms has a second amplitude; and in said exit region the amplitude of said one or more transient DC voltages or said one or more transient DC voltage waveforms has a third amplitude.

58. A mass spectrometer as claimed in claim 57, wherein the entrance and/or exit region comprise a proportion of the total axial length of said ion trap selected from the group consisting of: (i) <5%; (ii) 5–10%; (iii) 10–15%; (iv) 15–20%; (v) 20–25%; (vi) 25–30%; (vii) 30–35%; (viii) 35–40%; and (ix) 40–45%.

59. A mass spectrometer as claimed in claim 57, wherein said first and/or third amplitudes are substantially zero and said second amplitude is substantially non-zero.

60. A mass spectrometer as claimed in claim 57, wherein said second amplitude is larger than said first amplitude and/or said second amplitude is larger than said third amplitude.

61. A mass spectrometer as claimed in claim 50, wherein said one or more transient DC voltages or said one or more transient DC voltage waveforms applied to the electrodes forming said ion trap have a frequency, and wherein said frequency: (i) remains substantially constant; (ii) varies; (iii) increases; (iv) increases then decreases; (v) decreases; or (vi) decreases then increases.

62. A mass spectrometer as claimed in claim 50, wherein said one or more transient DC voltages or said one or more transient DC voltage waveforms applied to the electrodes forming said ion trap have a wavelength, and wherein said wavelength: (i) remains substantially constant; (ii) varies; (iii) increases; (iv) increases then decreases; (v) decreases; or (vi) decreases then increases.

63. A mass spectrometer as claimed in claim 50, wherein said one or more transient DC voltages or said one or more transient DC voltage waveforms are repeatedly generated and applied to the electrodes forming said ion trap, and wherein the frequency of generating said one or more transient DC voltages or said one or more transient DC voltage waveforms either: (i) remains substantially constant; (ii) varies; (iii) increases; (iv) increases then decreases; (v) decreases; or (vi) decreases then increases.

64. A mass spectrometer as claimed in claim 11, wherein said four or more axial trapping regions are translated along said ion trap with a first velocity and cause ions within said ion trap to pass along said ion trap with a second velocity.

65. A mass spectrometer as claimed in claim 64, wherein the difference between said first velocity and said second velocity is selected from the group consisting of: (i) less than or equal to 50 m/s; (ii) less than or equal to 40 m/s; (iii) less than or equal to 30 m/s; (iv) less than or equal to 20 m/s; (v) less than or equal to 10 m/s; (vi) less than or equal to 5 m/s; and (vii) less than or equal to 1 m/s.

66. A mass spectrometer as claimed in claim 64, wherein said first velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

67. A mass spectrometer as claimed in claim 64, wherein said second velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

68. A mass spectrometer as claimed in claim 64, wherein said second velocity is substantially the same as said first velocity.

69. A mass spectrometer as claimed in claim 11, wherein two or more transient DC voltages or two or more transient DC voltage waveforms are arranged to be applied to the electrodes forming said ion trap substantially simultaneously.

70. A mass spectrometer as claimed in claim 69, wherein said two or more transient DC voltages or said two or more transient DC voltage waveforms applied to the electrodes forming said ion trap are arranged so that potential barriers or potential wells move: (i) in the same direction; (ii) in opposite directions; (iii) towards each other; or (iv) away from each other.

71. A mass spectrometer as claimed in claim 11, further comprising a Time of Flight mass analyser comprising an electrode for injecting ions into a drift region, said electrode being arranged to be energised in use in a substantially synchronised manner with a pulse of ions emitted from the exit of said ion trap.

72. A mass spectrometer as claimed in claim 11, wherein said ion trap is selected from the group consisting of: (i) an ion funnel comprising a plurality of electrodes having apertures therein through which ions are transmitted, wherein the diameter of said apertures becomes progressively smaller or larger; (ii) an ion tunnel comprising a plurality of electrodes having apertures therein through which ions are transmitted, wherein the diameter of said apertures are substantially constant; and (iii) a stack of plate, ring or wire loop electrodes.

73. A mass spectrometer as claimed in claim 11, wherein said ion trap comprises a plurality of electrodes, each electrode having an aperture through which ions are transmitted in use.

74. A mass spectrometer as claimed in claim 73, wherein the diameter of the apertures of at least 50%, 60%, 70%, 80%, 90%, 95% or 100% of the electrodes forming said ion trap is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

75. A mass spectrometer as claimed in claim 11, wherein at least 10%, 20%, 30%, 40%, 50%, 60%, 70%, 80%, 90%, 95% or 100% of said electrodes have a substantially circular apertures.

76. A mass spectrometer as claimed in claim 11, wherein each electrode has a single aperture through which ions are transmitted in use.

77. A mass spectrometer as claimed in claim 11, wherein at least 50%, 60%, 70%, 80%, 90%, 95% or 100% of the electrodes forming the ion trap have apertures which are substantially the same size or area.

78. A mass spectrometer as claimed in claim 11, wherein said ion trap comprises a segmented rod set.

79. A mass spectrometer as claimed in claim 11, wherein said ion trap consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

80. A mass spectrometer as claimed in claim 11, wherein the thickness of at least 50%, 60%, 70%, 80%, 90%, 95% or 100% of said electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

81. A mass spectrometer as claimed in claim 11, wherein said ion trap has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

82. A mass spectrometer as claimed in claim 11, wherein at least 10%, 20%, 30%, 40%, 50%, 60%, 70%, 80%, 90%, 95% or 100% of said electrodes are connected to both a DC and an AC or RF voltage supply.

83. A mass spectrometer as claimed in claim 11, wherein axially adjacent electrodes are supplied with AC or RF voltages having a phase difference of 180°.

84. A mass spectrometer as claimed in claim 11, wherein in use one or more AC or RF voltage waveforms are applied to at least some of said electrodes so that ions are urged along at least a portion of the length of said ion trap.

85. A mass spectrometer as claimed in claim 11, further comprising an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) an Inductively Coupled Plasma ("ICP") ion source; (v) an Electron Impact ("EI) ion source; (vi) an Chemical Ionisation ("CI") ion source; (vii) a Fast Atom Bombardment ("FAB") ion source; (viii) a Liquid Secondary Ions Mass Spectrometry ("LSIMS") ion source; (ix) a Matrix Assisted Laser Desorption Ionisation ("MALDI") ion source; and (x) a Laser Desorption Ionisation ("LDI") ion source.

86. A mass spectrometer as claimed in claim 11, wherein in a mode of operation said four or more axial trapping regions are translated, in use, along said ion trap with a velocity which: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

87. A mass spectrometer as claimed in claim 11, wherein in use pulses of ions emerge from an exit of said ion trap.

88. A mass spectrometer as claimed in claim 11, wherein in use a complex mixture of ions is arranged to be trapped within said ion trap.

89. A mass spectrometer as claimed in claim 88, wherein said complex mixture comprises at least 5, 10, 15, 20, 25, 30, 35, 40, 50, 55, 60, 65, 70, 75, 80, 90, 95, 100, 150, 200, 250, 300, 350, 400, 450, 500, 550, 600, 650, 700, 750, 800, 850, 900, 950 or 1000 different species of ions, each species of ions having a substantially different mass to charge ratio.

90. A mass spectrometer as claimed in claim 88, further comprising a Matrix Assisted Laser Desorption Ionisation (MALDI) ion source.

91. A mass spectrometer as claimed in claim 11, wherein, in use, a complex mixture of ions is received into said ion trap and is fractionated by said ion trap, wherein at least some of said fractions are stored in separate axial trapping regions.

92. A mass spectrometer as claimed in claim 11, wherein in a mode of operation ions are ejected or allowed to exit from one or more axial trapping regions for subsequent mass analysis or for further experimentation.

93. A mass spectrometer as claimed in claim 92, wherein further experimentation comprises fragmentation and/or mass to charge ratio separation and/or ion mobility separation.

94. A method of mass spectrometry comprising:

providing an ion trap comprising a plurality of electrodes wherein at a first time $t_1$ ions enter said ion trap; and forming or creating four or more axial trapping regions at a second later time $t_2$ along at least a portion of the length of said ion traps, wherein at said second time $t_2$ at least some ions have travelled from said entrance at least 50% of the axial length of said ion trap towards said exit.

95. A method of mass spectrometry comprising:

providing an ion trap comprising a plurality of electrodes;

receiving ions within said ion trap;

trapping said ions in one or more axial trapping regions within said ion trap;

translating said one or more axial trapping regions along at least a portion of the axial length of said ion trap with an initial first velocity; and progressively reducing said first velocity to substantially zero.

96. A mass spectrometer comprising:

an ion trap comprising a plurality of electrodes wherein at a first time $t_1$ ions enter said ion trap and wherein at a second later time $t_2$ five or more axial trapping regions are formed or created along at least a portion of the length of said ion trap, and wherein at said second time $t_2$ at least some ions have travelled from said entrance at least 10% of the axial length of said ion trap towards said exit.

97. A method of mass spectrometry comprising:

providing an ion trap comprising a plurality of electrodes wherein at a first time $t_1$ ions enter said ion trap; and forming or creating five or more axial trapping regions at a second later time $t_2$ along at least a portion of the length of said ion trap, wherein at said second time $t_2$ at least some ions have travelled from said entrance at least 10% of the axial length of said ion trap towards said exit.

* * * * *